United States Patent [19]

Takeuchi

[11] Patent Number: 4,858,283

[45] Date of Patent: Aug. 22, 1989

[54] STRAP BUCKLE STRUCTURE

[75] Inventor: Fumio Takeuchi, Sayama, Japan

[73] Assignee: Citizen Watch Co., Ltd., Tokyo, Japan

[21] Appl. No.: 227,425

[22] Filed: Jul. 29, 1988

Related U.S. Application Data

[63] Continuation of Ser. No. 28,487, Mar. 20, 1987.

[30] Foreign Application Priority Data

Mar. 25, 1986 [JP] Japan ..... 66831

[51] Int. Cl.[4] ..... A44B 11/20

[52] U.S. Cl. ..... 24/178; 24/188; 24/265 WS

[58] Field of Search ..... 24/178, 163 K, 180, 24/188, 573, 265 B, 265 WS

[56] References Cited

U.S. PATENT DOCUMENTS

| | | | |
|---|---|---|---|
| 942,404 | 12/1909 | McGowan | 24/188 |
| 1,232,238 | 7/1917 | Depollier | 24/265 WS |
| 1,478,659 | 12/1923 | King | 24/178 R |
| 2,180,786 | 11/1939 | Alvarez et al. | 24/178 R |
| 3,160,938 | 12/1964 | Minutoli | 24/265 B |
| 3,252,194 | 5/1966 | Albiniano | 24/178 R |
| 3,286,391 | 11/1966 | Mengeringhausen | 24/573 |
| 4,564,308 | 1/1986 | Ikegami et al. | 24/265 WS |

FOREIGN PATENT DOCUMENTS

| | | |
|---|---|---|
| 58-80021 | 5/1983 | Japan . |
| 58-80022 | 5/1983 | Japan . |

*Primary Examiner*—Victor N. Sakran
*Attorney, Agent, or Firm*—Koda and Androlia

[57] ABSTRACT

A strap structure comprises a backle body (52) consisting of a synthetic resin material and having a two leg portions (52*e*, 52*f*), a mounting hole (52*a*) and mounting pin (52*b*). The mounting hole is provided at the end portion of one of the leg portions. The mounting pin is provided on the other one of the leg portions and has a small-diameter portion (52*c*) and a large-diameter portion (52*d*). The large-diameter portion is press fitted into the mounting hole which is formed that its diameter is larger than the small-diameter portion and is smaller than the large-diameter portion.

4 Claims, 4 Drawing Sheets

STRAP BUCKLE STRUCTURE

This is a continuation of application Ser. No. 028,487, filed Mar. 20, 1987.

BACKGROUND OF THE INVENTION

1. Field of the Invention

This invention relates to the structure of a buckle made of synthetic resin for a strap used in a wrist watch or the like.

2. Prior Art

Synthetic resin has recently come to be used as the material for the buckle body of a strap since it is highly economical which results from mass productivity and has resilience which is helpful during assembly. The buckle body usually has a generally C-shaped configuration having the two leg portions. Each of the leg portions has a recess or hole at end portion thereof. A spring rod having a slider pushed by spring so as to project in an outward direction or a pin is set between the leg portions of the buckle body by inserting the slider into the recesses or holes of the leg portions. However, the buckle body has little rigidity since it is made of a synthetic resin, so that the spring rod or pin readily slips out from between the two leg portions of the buckle body when these two leg portions are spread apart by an external force.

To eliminate this shortcoming, it has been propoased as illustrated in Japanese Utility Model Application Laid-Open No. 58-80022 to press fit a metallic mounting pin into one hole of the C-shaped buckle body so that the mounting pin will not slip out of the buckle body.

A prior-art example of a strap buckle using this press-fitted arrangement is shown in the perspective view of FIG. 5 and the plan view of FIG. 6. A generally C-shaped buckle body 10 is made of a synthetic resin material and includes opposing first and second leg portions 12, 14 including first and second stepped holes 16, 18 formed at their end portions, respectively, having a stepped cross section. These first and second holes 16, 18 each have a small diameter on the inner side (sides of opposing faces of the first and second leg portions 12, 14) and a larger diameter on the outer side (sides of outer faces of the first and second leg portions 12, 14).

A mounting pin 20 for connecting the first leg portion 12 and second leg portion 14 has one end thereof formed to include a small-diameter neck portion 22 and a large-diameter locking projection 24 provided at the tip of the neck portion 22. The locking projection 24 has an outer peripheral side surface which tapers off to the tip of the projection and the maximum diameter being made smaller than the small-diameter portion of stepped first hole 16. The other end of mounting pin 20 is formed to include a head 26 having a diameter larger than the small-diameter portion of the stepped second hole 18. The small-diameter portion of the stepped second hole 18 is sized to allow the locking projection 24 as well as a main portion 28 of the mounting pin 20 to be passed therethrough.

When the first leg portion 12 and second leg portion 14 of the buckle body 10 are connected by the mounting pin 20, the locking projection 24 of the mounting pin 20 is passed through the stepped second hole 18 toward the side having the stepped first hole 16. Then the mounting pin 20 is passed through an insertion hole 32 of a strap 30 and a looped portion 36 of a tongue 34. After the locking projection 24 reaches to the entrance to the stepped first hole 16, the mounting pin 20 is pushed forwardly to connect the locking projection 24 to the step portion of the stepped first hole 16. Though the maximum diameter of the locking projection 24 is greater than the small-diameter portion of stepped first hole 16, owing to resilience of the buckle body 10 consisting of the synthetic resin, the locking projection 24 passes through the small-diameter portion of first hole 16 and reaches to the large-diameter portion. With the locking projection 24 thus press fitted into the stepped first hole 16, the head 26 at the other end of mounting pin 20 reaches to the step of the second hole 18.

Thus, the arrangement is such that locking projection 24 at the tip of the mounting pin 20 is press fitted into the stepped first hole 16. As a result, the locking projection 24 cannot return through the small-diameter portion of first hole 16. This eliminates the shortcoming of the prior art wherein the mounting pin 20 slips out of the buckle body 10.

The other prior-art example of a strap buckle has been illustrated in Japanese Utility Model Application Laid-Open No. 58-80021, such as shown in FIGS. 7 to 9.

This buckle includes a C-shaped buckle body 38 made of synthetic resin and first and second mounting pins 44, 46 formed at opposing surfaces of the leg portions 40, 42 of the buckle body 38, respectively. In this structure, the first and second mounting pins 44, 46 are provided with locking portion 48 as same as the locking projection 24 and neck portion 22 of the above-mentioned prior art and locking hole 50 having a configuration fitting the locking portion 48, respectively. The first and second mounting pins 44, 46 are press fitted by pressing the locking portion 48 into the locking hole 50.

In the structure of the former prior art shown in FIGS. 5 and 6, the metallic mounting pin 20 is required in addition to the buckle body 10, and also the mounting pin 20 must be formed to include the large-diameter head 26. Since a pin blank the diameter of which is larger than that of the head 26 must be cut away in order to make the metallic mounting pin 20 having the large-diameter head 26, costs are high and making the metallic mounting pin 20 is not suitable for mass production.

Further, in the structure of the latter prior art shown in FIGS. 7, 8 and 9, it is necessary to make the diameter of the locking portion 48 and locking hole 50 into larger diameter for taking sufficient strength. Therefore, the hole of the strap must be changed to larger hole, too. Furthermore, since the connecting portion of the first and second mounting pins 44, 46 is located to the middle of the whole mounting pin, the connecting portion directly receives the force added to the mounting pins. Thus, the connecting portion is in danger of separation always. Moreover, when the first and second mounting pins 44, 46 are inserted into the hole of the strap, the leg portions 40, 42 of the buckle body 38 must be spread apart largely, therefore, work efficiency of fabricating the buckle deteriorates.

SUMMARY OF THE INVENTION

An object of the present invention is to provide a strap buckle structure which enables costs to be reduced by integrally forming the buckle body and mounting pin of a synthetic resin material, in which the resilience of the synthetic resin material is utilized to enable the two leg portions of the buckle body to be spread apart slightly, whereby the mounting pin having a strap and a tongue mounted thereon can be press fitted and secured in a mounting hole in a leg of the buckle body, and in which sufficient strength is performed.

In keeping with the principles of the present invention, the above-mentioned objects are accomplished by a strap buckle structure comprising a strap; a tongue; a backle body consisting of a synthetic resin material and having a generally C-shaped configuration, two leg portions and a mounting hole provided at the end portion of one of said leg portions; and a mounting pin provided on the other one of said leg portions and extending to the opposite leg portion, said mounting pin having a small-diameter portion provided at its tip and a large-diameter portion provided at the tip of said small-diameter portion, said large-diameter portion having an outer peripheral side surface which tapers off to its tip; wherein said mounting hole is formed that its diameter is larger than said small-diameter portion of said mounting pin and is smaller than said larger-diameter portion of said mounting pin, and wherein said large-diameter portion of said mounting pin is press fitted into said mounting hole after said mounting pin is passed through said strap and said tongue.

BRIEF DESCRIPTION OF THE DRAWINGS

The above-mentioned features and objects of the present invention will become more apparent with reference to the following description taken in conjunction with the accompanying drawings wherein.

DETAILED DESCRIPTION OF THE INVENTION

Figure 1:
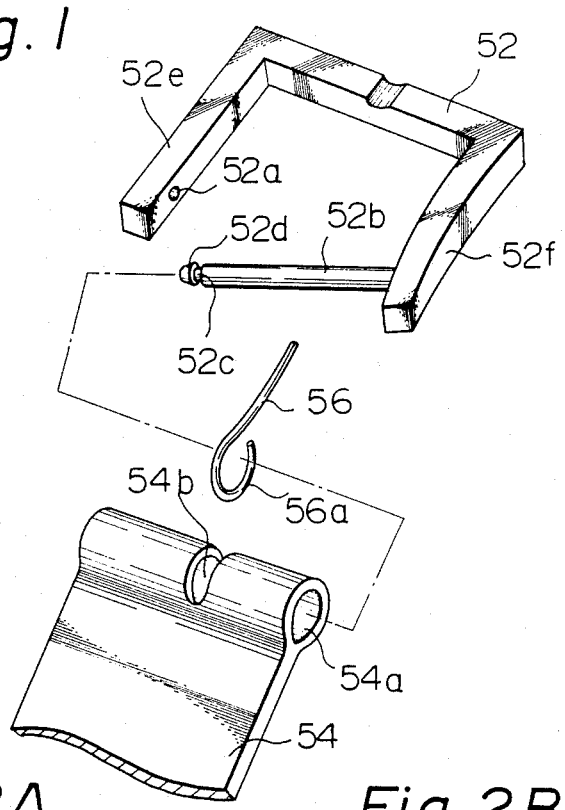
FIG. 1 is a perspective view of a first embodiment of a buckle according to the present invention.
Figure 2A:
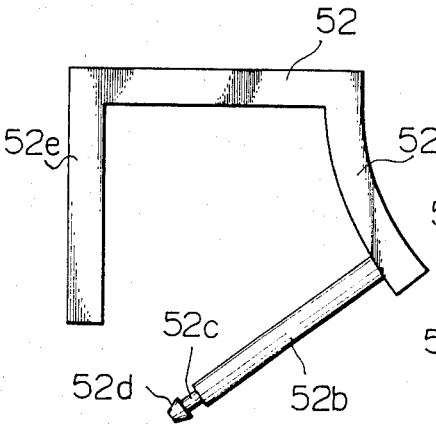
FIG. 2A is a plan view prior to assembly of the buckle shown in FIG. 1.
Figure 2B:
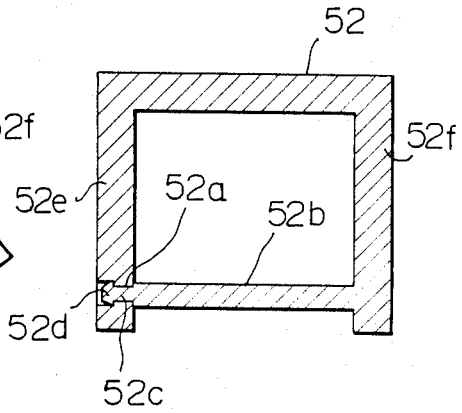
FIG. 2B is a sectional view following assembly of the buckle shown in FIG. 1.

Referring now to FIG. 1, there is shown a first embodiment of the present invention.

A buckle body 52 is made of a synthetic resin material and has a generally C-shaped configuration and two leg portions 52*e*, 52*f*. Since the buckle body 52 has the resilience, it is possible to spread the leg portions 52*e*, 52*f*. A mounting hole 52*a* is provided in the end portion of the leg portion 52*e*. A mounting pin 52*b* is provided on the end portion of the leg portion 52*f*.

The mounting pin 52*b* has a small-diameter portion 52*c* at its tip and a large-diameter portion 52*d* provided at the tip of the small-diameter portion. This large-diameter portion 52*d* has an outer peripheral side surface which tapers off to its tip.

The mounting hole 52*a* is formed so that its inner diameter (on the side of opposing face to the mounting pin) is larger than the outer diameter of small-diameter portion 52*c* and smaller than the outer diameter of the large-diameter portion 52*d*.

Numeral 54 denotes a strap the distal end of which has a hollow portion 54*a*.

Numeral 56 denotes a tongue inserted into a locking hole of the other strap (not shown) for connecting a pair of straps through the buckle. One end of the tongue 56 has a mounting portion 56*a* obtained by forming this end into a loop.

In order to attach the strap 54 and tongue 56 to the buckle body 52, the two leg portions 52*e*, 52*f* of the buckle body 52 are spread apart, and then the hollow portion 54*a* of strap 54 is slipped over the mounting pin 52*b*. When the large-diameter portion 52*d* reaches the position of a slit 54*b* formed at the middle of the hollow portion 54*a*, the mounting portion 56*a* of tongue 56 is inserted into the slit 54*b* and the mounting pin 52*b* is passed through the mounting portion 56*a* of tongue 56.

Next, the large-diameter portion 52*d* at the end of the mounting pin 52*b* is moved to the position of the mounting hole 52*a*. At this time, the mounting pin 52*b* and the mounting hole 52*a* of the buckle body 52 are placed on the same plane, whereby the mounting pin 52*b* is horizontally moved without twisting the leg portion 52*f*. In this case, the tip of the mounting pin 52*b* is struck on the inner wall of the leg portion 52*e* generally and is reduced to the mounting hole 52*a* by sliding the tip of the mounting pin on the inner wall of the leg portion 52*e*. Then, the leg portion 52*f* of the buckle body 52 is pressed from its outer side, whereby the large-diameter portion 52*d* is press fitted into the mounting hole 52*a*. This completes the attaching procedure.

Figure 3:
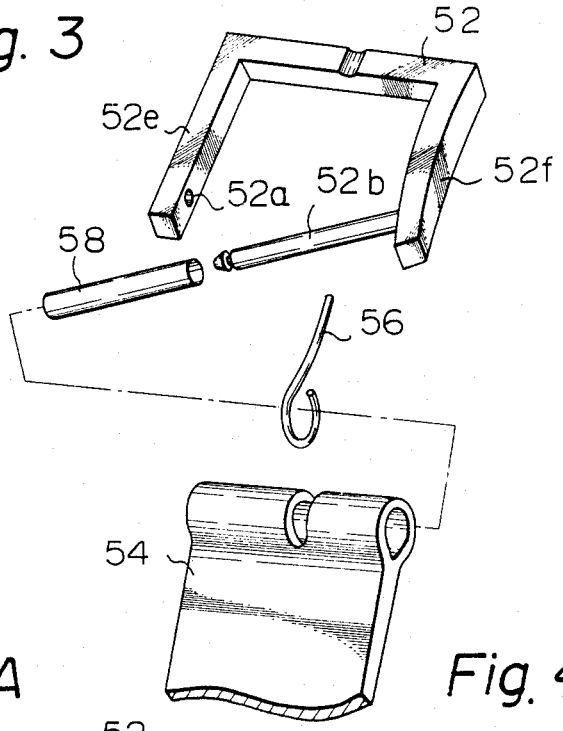
FIG. 3 is an perspective view of a second embodiment of a buckle according to the present invention.
Figure 4A:
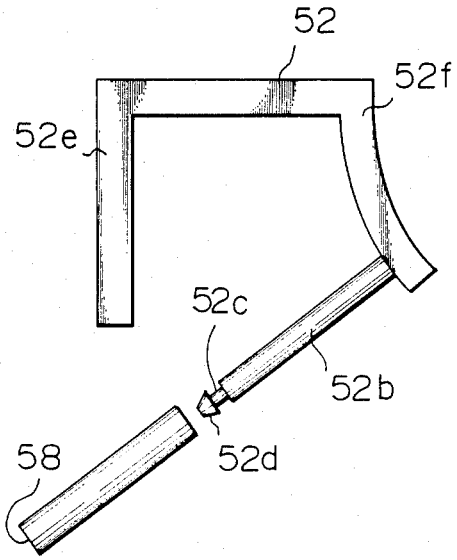
FIG. 4A is a plan view prior to assembly of the buckle shown in FIG. 3.
Figure 4B:
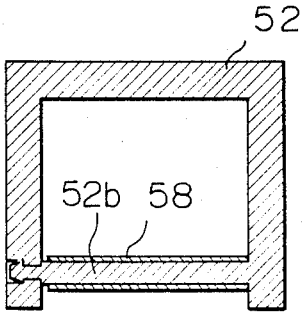
FIG. 4B is a sectional view following assembly of the buckle shown in FIG. 3.
Figure 5:
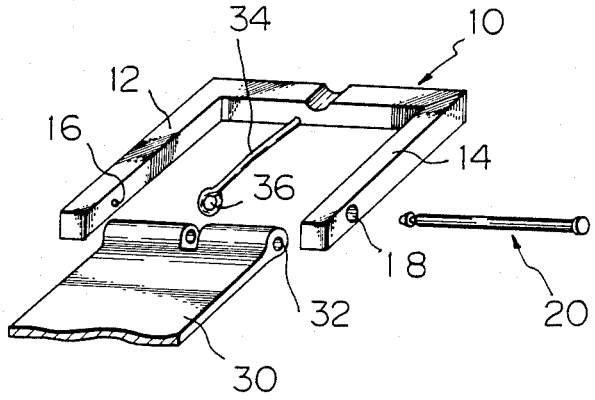
Fig. 5 PRIOR ART
FIG. 5 is a perspective view of a conventional buckle.
Figure 6:
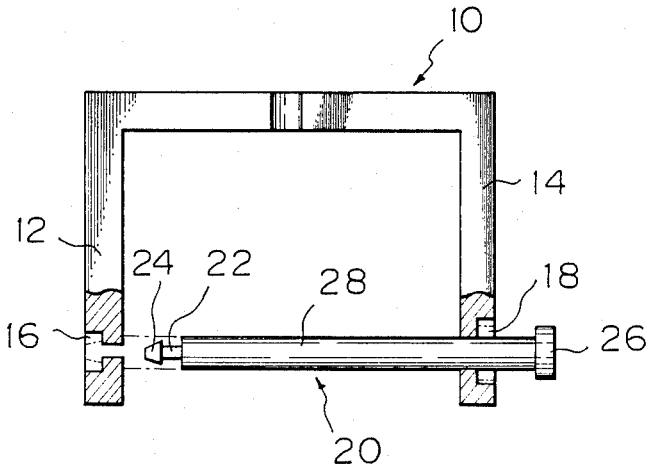
Fig. 6 PRIOR ART
FIG. 6 is a plane view, partially shown in section, illustrating the arrangement of FIG. 5 in the assembled state.

Another embodiment of the present invention will now be described with reference to FIGS. 3 and 4. In the present embodiment, reference numerals identical with those shown in FIG. 1 designate like parts.

In the present embodiment, the mounting pin which consists of the synthetic resin is covered with a metallic pipe 58, thereby providing greater strength.

As set forth above, in accordance with the strap buckle structure according to the present invention, the buckle body and mounting pin are integrally formed of a synthetic resin material so that cost can be reduced.

Further, by utilizing the resilience of the synthetic resin material, the strap and tongue can be attached to the buckle body with ease, thereby improving operability.

Further, the mounting pin is formed by one body, whereby the mounting pin has sufficient strength for connecting the buckle body to the strap even if its diameter is reduced.

Figure 7:
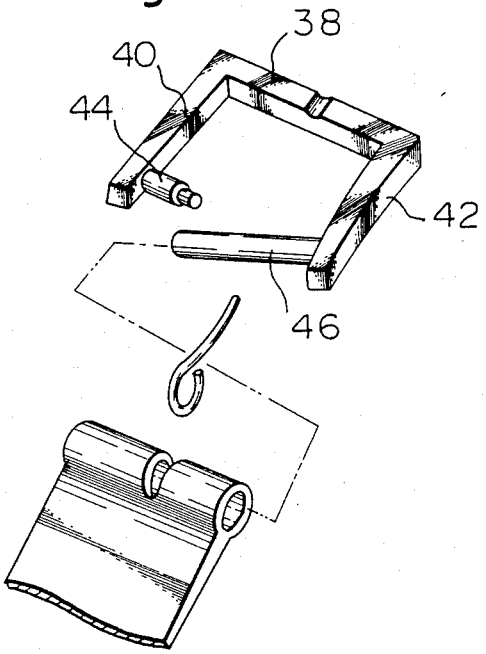
Fig. 7 PRIOR ART
FIG. 7 is a perspective view of the other conventional buckle.
Figure 8:
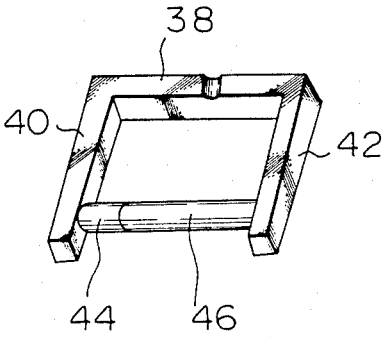
Fig. 8 PRIOR ART
FIG. 8 is a perspective view of the buckle shown in FIG. 7 in the assembled state.
Figure 9:
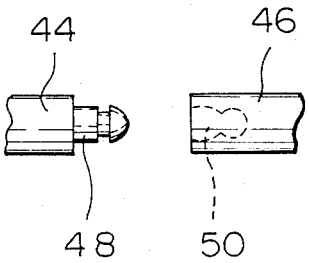
Fig. 9 PRIOR ART
FIG. 9 is a enlarged perspective view of a connecting portion of mounting pins of the buckle shown in FIG. 7.

Moreover, the mounting pin can be covered with the hollow portion of the strap or the pipe by slightly spreading the leg portions of the buckle body since the length of from the portion of the pin which is united to the one leg portion to the portion of the pin which is left is longer than that of the pin of the prior art shown in FIGS. 7 to 9.

I claim:

1. In a strap buckle structure including a strap having a hollow portion provided at its end portion and a slit provided at the middle of said hollow portion, a tongue having a mounting portion, a buckle body consisting of a synthetic resin material and having a generally C-shaped configuration and first and second leg portions provided in parallel and having resilient force, the improvement comprising:

a mounting pin integrally provided on said second leg portion and extending to said first leg portion, said mounting pin having a length more than a distance between inner opposite surfaces of said first and second leg portions, a small-diameter portion provided at its tip and a large-diameter portion provided at the tip of said small-diameter portion, said large-diameter portion having an outer peripheral side surface which tapers off to its tip and a circular surface facing said small-diameter portion and substantially formed into a flat surface; and a mounting hole provided at the end portion of said first leg portion and including a small-diameter hole facing said mounting pin and having a diameter larger than said small-diameter portion of said mounting pin and smaller than said large-diameter portion of said mounting pin, a large-diameter hole connected with said small-diameter hole and having a diameter larger than said large-diameter portion of said mounting pin and a circular surface formed at a periphery of an inside opening of said small-diameter hole and substantially formed into a flat surface; and wherein said mounting pin is laid between said first and second leg portions with spreading said first and second leg portions and is temporarily fitted by being pressed in the direction of said mounting hole by the resilient force of said first and second leg portions after said hollow portion of said strap is slipped over said mounting pin and said tongue is mounted to said mounting pin at said slit of said strap, wherein said large-diameter portion of said mounting pin reaches said large-diameter hole through said small-diameter hole by pressing said first and second leg portions, and wherein said mounting pin is fitted into said mounting hole with said circular surface of said large-diameter portion of said mounting pin engaging said circular surface of said mounting hole.

2. The improvement as set forth in claim 1, wherein the tip of said large-diameter portion fits into an opening portion of said mounting hole and is placed at the fitting position.

3. The improvement as set forth in claim 1, wherein said large-diameter portion is connected to a peripheral portion of said inner portion after passing through said inner portion, without protruding the tip of said large-diameter portion outside said mounting hole.

4. The improvement as set forth in claim 1, wherein said mounting pin and said mounting hole of said buckle body are placed on the same plane.

* * * * *